US005235707A

United States Patent [19]

Wang-on

[11] Patent Number: 5,235,707

[45] Date of Patent: Aug. 17, 1993

[54] WATER TANK FOR A FLUSHING SYSTEM WITH TWO-STEP FLOW CONTROL

[76] Inventor: Kwok Wang-on, Flat D, 3rd Floor, No. 172, Wai Yip Street, Kwun Tong, Kowloon, Hong Kong

[21] Appl. No.: 5,816

[22] Filed: Jan. 19, 1993

Related U.S. Application Data

[63] Continuation-in-part of Ser. No. 759,151, Sep. 13, 1991, abandoned.

[51] Int. Cl.[5] ..... E03D 1/14

[52] U.S. Cl. ..... 4/324

[58] Field of Search ..... 4/324, 325, 415

[56] References Cited

U.S. PATENT DOCUMENTS

| | | | |
|---|---|---|---|
| 3,885,253 | 5/1975 | Overbey | 4/325 |
| 4,651,359 | 3/1987 | Battle | 4/324 |
| 4,750,220 | 6/1988 | Baumann | 4/415 X |
| 4,945,581 | 8/1990 | Harris | 4/325 |
| 5,023,960 | 6/1991 | Ratanagsu | 4/324 X |

FOREIGN PATENT DOCUMENTS

| | | | |
|---|---|---|---|
| 2077790 | 12/1981 | United Kingdom | 4/324 |

*Primary Examiner*—Charles E. Phillips

*Attorney, Agent, or Firm*—Morton J. Rosenberg; David I. Klein

[57] ABSTRACT

A water tank for a flushing system comprising two control knobs for two-step flow control, wherein the valve cap of the drain valve in the water tank is opened for completely draining all of the water out of the water tank when a first control knob is rotated. The valve cap of the drain valve in the water tank is opened and a float is released from the restraint of a rocker arm when a second control knob is rotated. The valve cap of the drain valve is then forced to close by the released float, after half the volume of the water has been discharged from the water tank.

1 Claim, 7 Drawing Sheets

WATER TANK FOR A FLUSHING SYSTEM WITH TWO-STEP FLOW CONTROL

REFERENCES TO RELATED PATENT APPLICATIONS

This patent application is a continuation-in-part patent application of U.S. patent application Ser. No. 759,151, filed Sep. 13, 1991 now abandoned.

BACKGROUND OF THE INVENTION

The present invention relates to a water tank for a flushing system and relates more particularly to a water tank which can be alternately controlled to discharge a different volume of water.

In most industrialized, as well as developing countries, water pollution has become one of the problems which deteriorates the quality of living conditions. Because of water pollution, hygienic water sources become difficult to obtain. Therefore, the government in every country commonly requests people to consume water economically.

SUMMARY OF THE INVENTION

It is the main object of the present invention to provide a water tank for a flushing system which can be controlled to completely drain off water for washing a lavatory bowl or to discharge half the water from the water tank for washing the lavatory bowl.

According to the present invention, there is provided a water tank for a flushing system which comprises a main control knob for controlling the opening or closing of a valve cap of a drain valve. A holder is fastened inside the housing of the water tank, above the valve cap of the drain valve, and a float is movably disposed inside the holder and releasably retained by a rocker arm. An auxiliary control knob is provided for displacing the rocker arm away from engagement with the float. Rotating the main control knob causes the water tank to completely drain off the water contained therein. Rotating the auxiliary control knob causes the valve cap to open for the discharging therethrough of the water contained in the water tank, and at the same time, causes the float to be released from the constraint of the rocker arm. When the float is released from the rocker arm, it follows the discharging water moving downwardly. When the float contacts the valve cap, it causes the valve cap to close the drain valve, and the water is thereby stopped from discharging out of the water tank.

DETAILED DESCRIPTION OF THE PREFERRED EMBODIMENT

Figure 1:
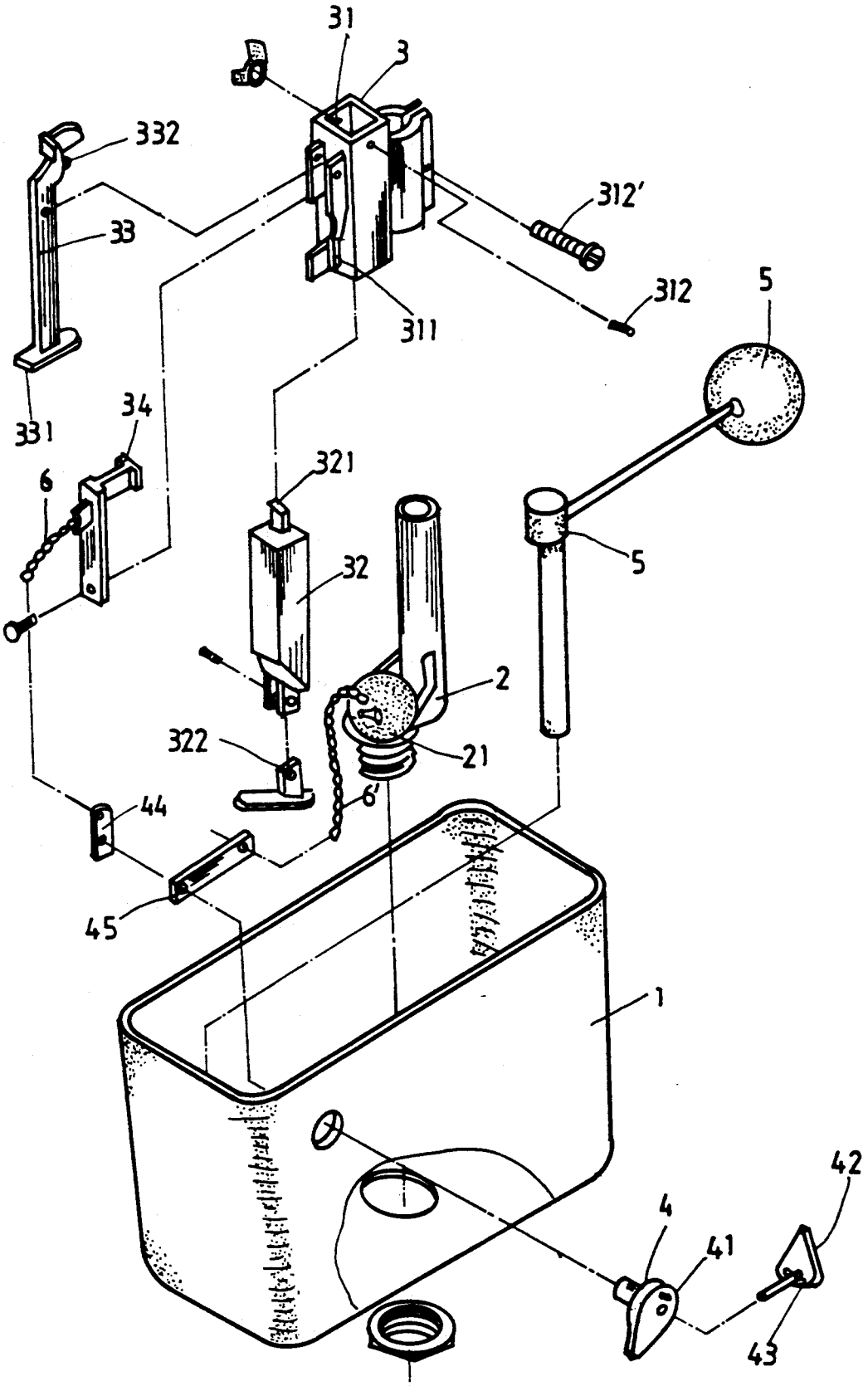
FIG. 1 is an exploded perspective view of the preferred embodiment of the water tank of the present invention.
Figure 2:
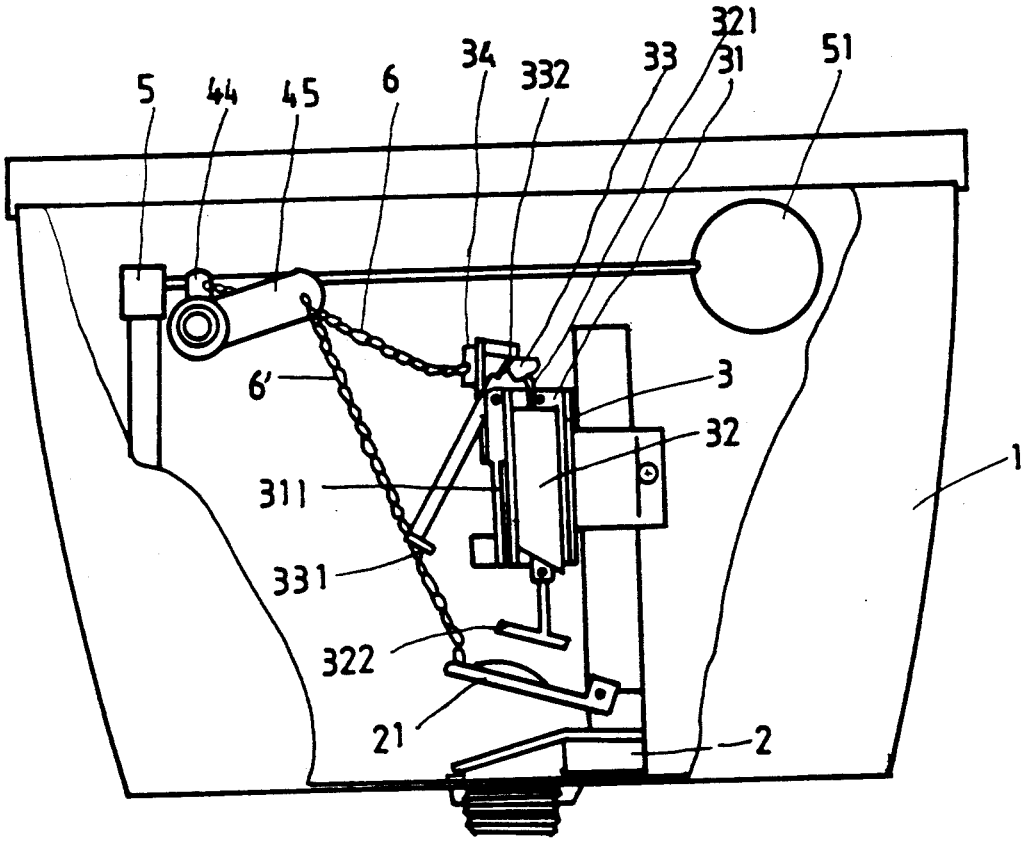
FIG. 2 is an elevation view partially cut-away showing that the valve cap of the drain valve is pulled open by means of the operation of the second control knob.
Figure 3:
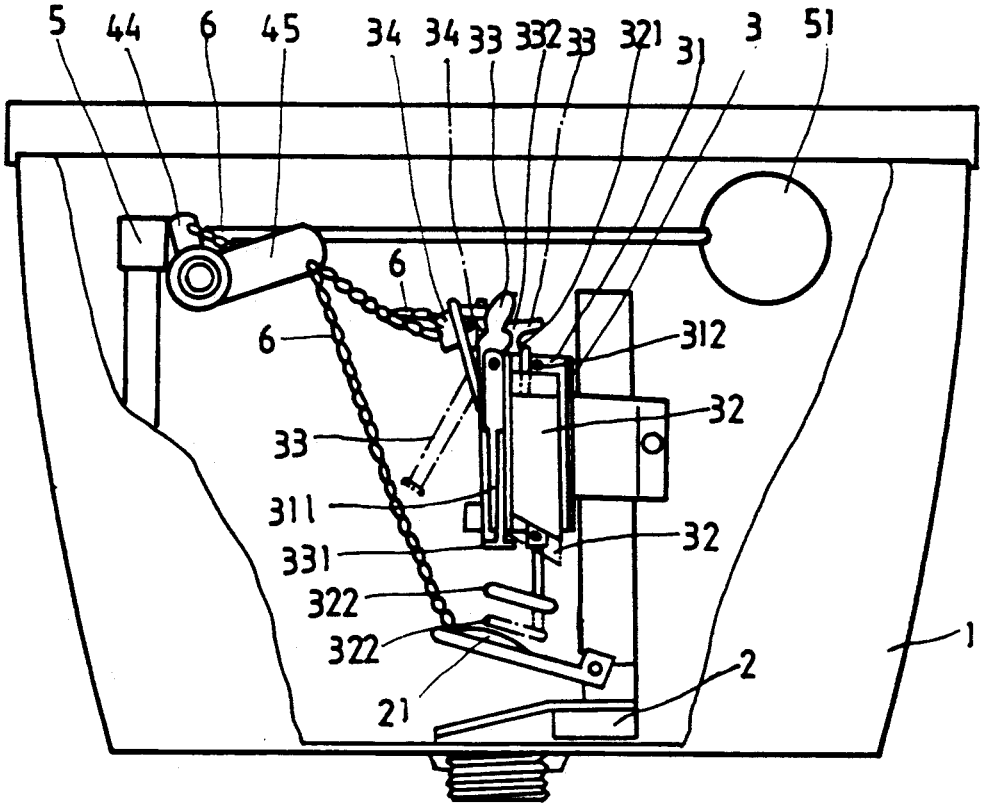
FIG. 3 is an elevation view partially cut-away showing that the valve cap of the drain valve is pulled to open and the float is released from the constraint of the rocker arm when the first control knob is rotated.

Referring to FIGS. 1, 2 and 3, a holder 3 is fastened inside a water tank 1 above the valve cap 21 of a drain valve 2 in a flushing system, by screw 312'. The tubular structure of holder 3 defines therein a guide hole 31 for holding a float 32. The float 32 has a hook 321 formed at the top end and a pressure bar 322 disposed at the bottom end thereof. A rocker arm 33 is pivotedly coupled to the holder 3 on one side thereof, the rocker arm 33 having a hook 332 formed at its top end which engages in the hook 321 of the float 32. The rocker arm 33 being pivotedly coupled to the holder 3 through an opening formed adjacent the end of rocker arm 33 having the hook 332. Therefore, the downward movement of the float 32 is restrained by the hook 332 of the rocker arm 33. A spring plate 34 is secured to the holder 3 on one side thereof, and connected to a link 44 by a chain 6. The opposing end of link 44 is coupled to an auxiliary control knob 42.

A main control knob 4 is also provided with link 46 coupled thereto. The opposing end of link 45 is secured to a chain 6' which is connected to the valve cap 21 on its opposing end. The main control knob 4 is formed with a pin 41 extending therefrom for engagement with a curved groove 43 formed in the auxiliary control knob 42. Auxiliary control knob 42 includes a shaft which extends through an opening formed in main control knob 4 for coupling with link 44. When the main control knob 4 is rotated, the pin 41 is displaced within the groove 43, and therefore, the main control knob 4 is displaced independently of auxiliary control knob 42, the auxiliary control knob 42 remaining stationary.

Rotation of the main control knob 4 causes the link 45 to pull the chain 6', and thereby lift the valve cap 21 to an open position for permitting water to drain fully from the water tank 1. When the auxiliary control knob 42 is rotated, however, the main control knob 4 will also be rotated therewith. As one end of the curved groove 43 engages the pin 41, both control knobs will be rotated together. Therefore, when the main control knob 4 is rotated by displacement of auxiliary control knob 42, the valve cap 21 is pulled to an open position by the link 45 of the chain 6'. At the same time, the link 44 pulls the upper portion of spring plate 34 away from the holder 3 via the chain 6 to displace the rocker arm 33.

Figure 6:
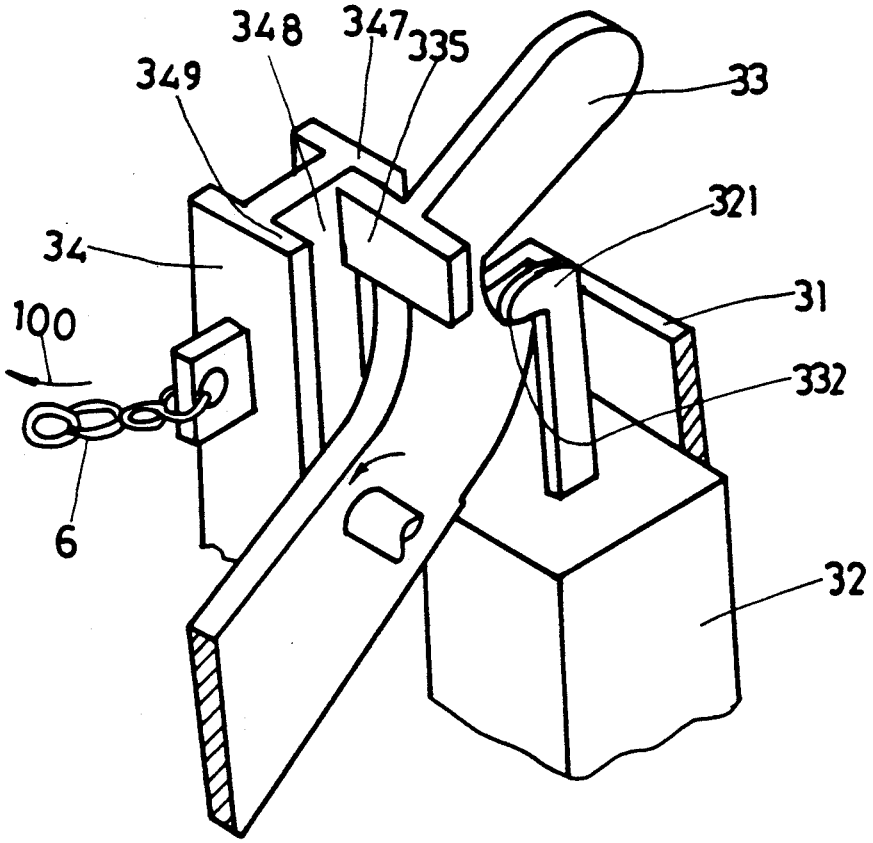
FIG. 6 is a perspective enlarged view of a portion of the float retention by the rocker arm.
Figure 7A:
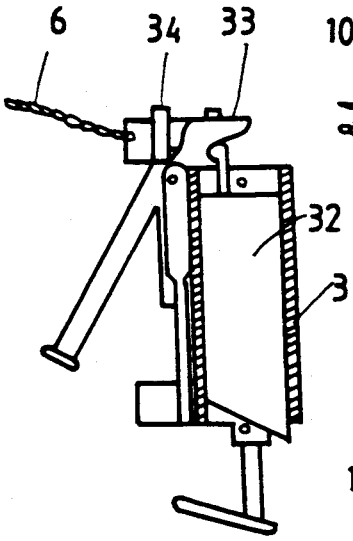
FIGS. 7A-7C are diagrammatic representations of the operation of the rocker arm with respect to the float; and, FIG. 8 is an elevation view of the holder of the present invention.
Figure 7B:
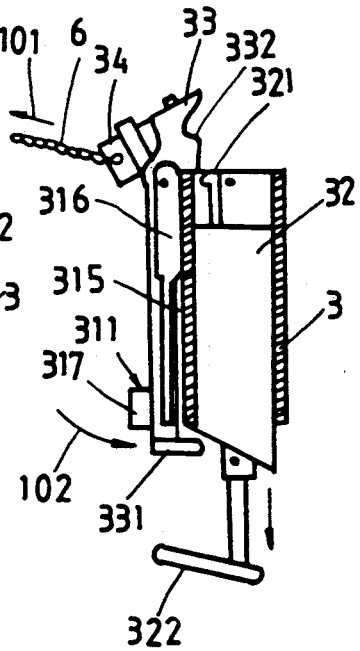

Referring now to FIG. 6, there is shown, the interface between rocker arm 33 and spring plate 34. The upper portion of spring plate 34 is provided with a channel 48 in which extends a tab portion 335 of rocker arm 33. Thus, when chain 6 is pulled, displacing it in the direction indicated by directional arrow 100, the forward edge 347 of the channel portion of spring plate 34 engages tab 335 and causes the rocker arm to rotate about its pivot point, and thereby release the engagement of hook 321 with the hook portion 332 of rocker arm 33. The spring plate 34 is pulled by the link 44 through the chain 6, which in turn causes rocker arm 33 to rotate through a particular angle by virtue of the interface between plate 34 and arm 33, as previously described. Once the hook 321 of float 32 is released from the restraint of rocker arm 33, the float 32 drops with the falling water level. The rocker arm 33 is temporarily held in a vertical position by a clamp 311, formed on and extending from holder 3, having been displaced to that position by the respective displacement of spring plate 34. As shown in FIG. 7A, the float 32 is initially engaged with the rocker arm 33 until the chain 6 is displaced, pulling the rocker arm 34 in the direction indicated by directional arrow 101, as shown in FIG. 7B. Responsive to the displacement of spring plate 34, rocker arm 33 is caused to rotate in a direction, indicated by directional arrow 102, until in a substantially vertical position, and then being temporarily maintained there by clamp 311.

Figure 8:
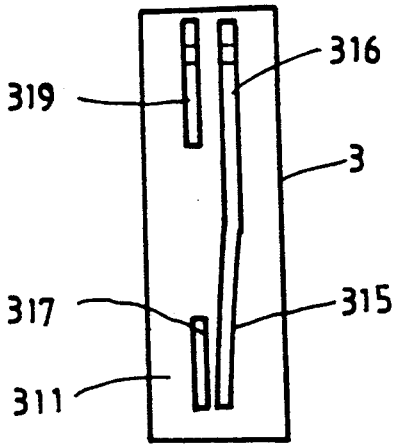

Referring to FIGS. 7B and 8, the clamp 311 is shown as comprising a plate 317 extending from the face of holder 3, adjacent the lower end thereof, and a cantilevered arm member 315 disposed in spaced parallel relation therewith. Cantilevered arm member extends from an upper portion 316 affixed to and extending from the face of housing 3, adjacent the upper end thereof and acts as a spring-like element to apply a force to the rocker arm 33 when it is positioned between plate 317 and member 315. The upper portion 316 of cantilevered arm member 315 in combination with the spaced parallel member 319 provide the pivotal mounting for rocker arm member 33, which is disposed therebetween by means of a pin or the like extending through openings formed in upper portion 316, rocker arm 33 and the member 319.

Figure 7C:
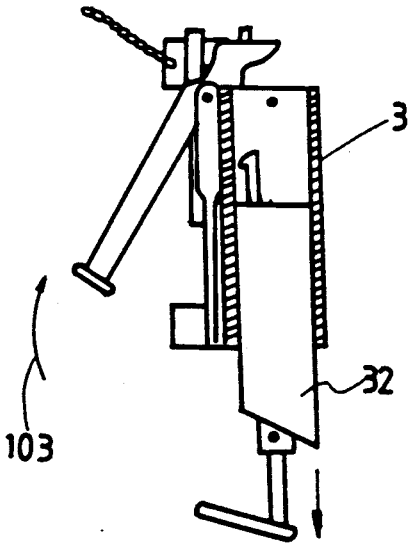

When the float 32 drops downward, the foot-shaped end 331 formed on the rocker arm 33, at its bottom end, is pushed by the beveled bottom edge of float 32, causing the rocker arm 33 to be displaced from between the members 317 and 315, as indicated by directional arrow 103 in FIG. 7C, to the extent that it is free of clamp 311, and returns to its original inclined position. The channel 348 formed in spring plate 34 is of sufficient size to permit the spring plate 34 to be returned to its original position without the rear edge 349 contacting the tap 335. Thus, spring plate 34 when returned to its original position does not interfere with the engagement of rocker arm 33 with clamp 311.

Figure 4:
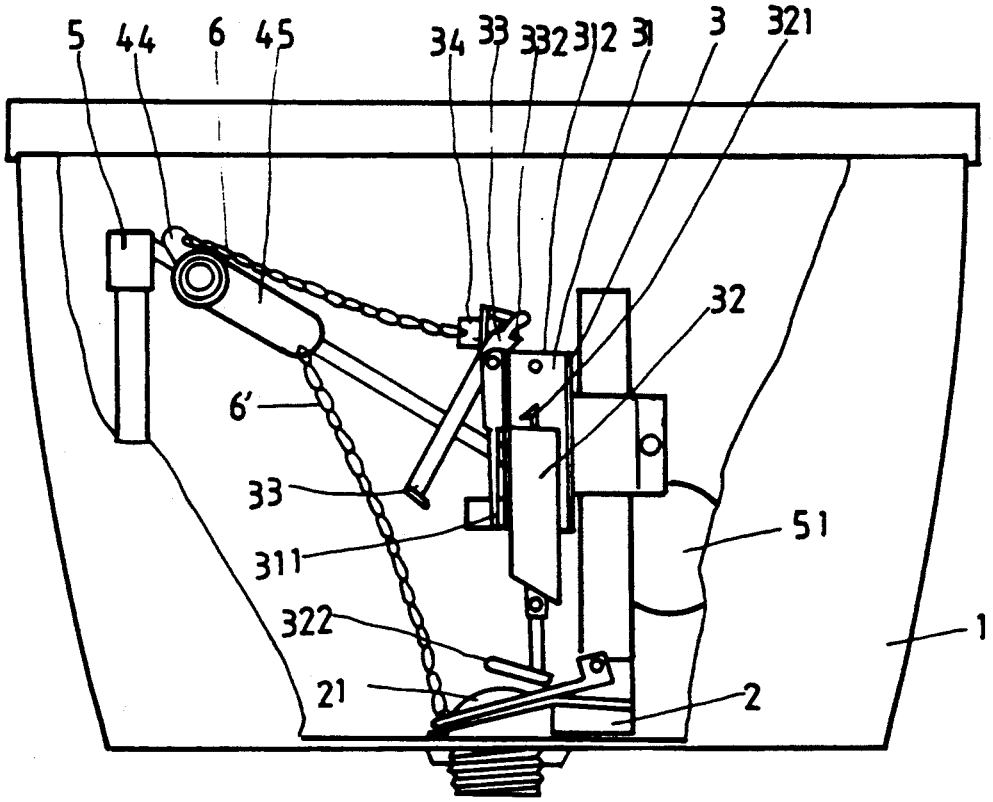
FIG. 4 is an elevation view partially cut-away of the water tank showing the float is moving downwards with its pressure bar pressed on the valve cap of the drain valve.
Figure 5:
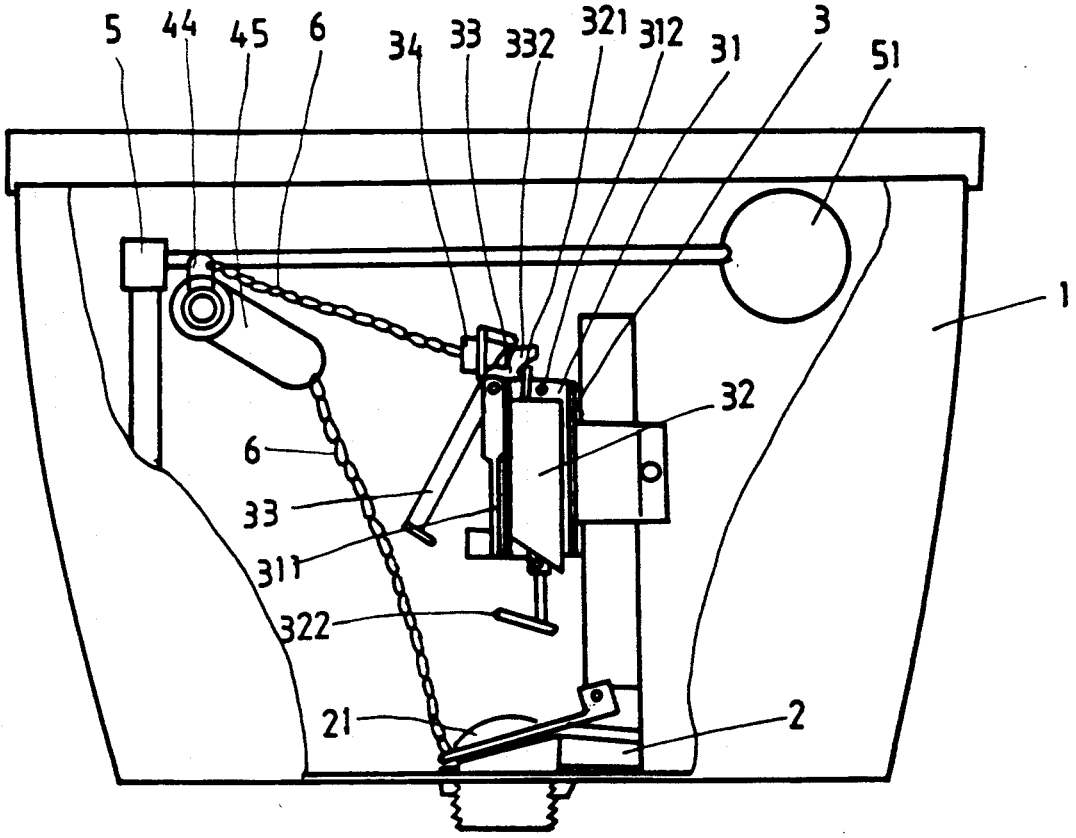
FIG. 5 is an elevation view partially cut-away of the internal parts of the water tank before a flushing operation.

Rocker arm 33 returns to its original inclined position by virtue of its center of gravity with respect to its pivot point. Thus, rocker arm 33 is provided with sufficient mass above the pivot point to permit its rotation from the vertical position shown in FIG. 7B to the inclined position shown in FIG. 7C, by virtue of gravity. Thus, when the water level drops the inclined portion of float 32 causes displacement of the lower end of rocker arm 33, by virtue of its contact with the foot-shaped portion 331 of rocker arm 33, displacing rocker arm 33 from its engagement with clamp 311. Subsequently, as the water level continues to drop to a predetermined height, the pressure bar 332, at the bottom end of float 32, presses on the valve cap 21, causing it to close, as shown in FIG. 4, before the tank has completely drained.

The forced closing of valve cap 21 provides a flushing operation using only half the volume of water from the water tank 1. Since the float ball 51 has dropped down from a higher level to a lower level, the water supply valve 5 linked to float ball 51 is opened, to supply water into the tank 1 and thereby causes the float 32 to be subsequently moved upwards by the increasing water level. As soon as the float is moved upwards to an upper limit position, the hook 321 becomes engaged with the hook 332 on rocker arm 33, again. Further, the holder 3 is provided with a stop means in the form of screw 312, to limit the upstroke of float 32.

Although this invention has been described in connection with specific forms and embodiment thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. In a water tank for a toilet flushing system of the type having a drain valve with a displaceable valve cap for control of the flushing, the improvement comprising:

a tubularly shaped holder coupled to said drain valve in axial alignment with said valve cap and in vertically spaced relation therewith, said holder having an axially directed through passage formed therein;

a rocker arm member pivotally coupled to a side of said holder through an opening formed adjacent a first end thereof, said rocker arm having a hook formed on said first end and a foot shaped portion formed on a second end thereof;

a float member slidingly disposed within said axially directed through passage, said float member having a hook shaped portion formed on an upper end thereof for releasable coupling with said rocker arm hook when said rocker arm is disposed at a predetermined angle with respect to said holder, said float member having a pressing bar extending a predetermined distance from an inclined lower end thereof;

a spring plate member having a first end coupled to said holder for releasably holding said rocker arm in said predetermined angular position;

a first control knob rotatably coupled to a wall of said water tank for coupling with one end of a first link member disposed within said water tank, said first link member being coupled on an opposing end to one end of a first chain member, said first chain member having an opposing end coupled to said valve cap for displacement thereof to open said drain valve responsive to rotational displacement of said first control knob; and, a second control knob rotatably coupled to said wall of said water tank having a shaft portion extending through an opening formed in said first control knob for coupling with one end of a second link member, said second link member having an opposing end coupled to one end of a second chain member, said second chain member having an opposing end coupled to a second end of said spring plate member for displacement thereof responsive to rotational displacement of said second control knob, wherein said displacement of said spring plate member pivots said rocker arm and thereby releases said float member for closing of said drain valve responsive to said pressing bar contacting said valve cap as a water level within said water tank lowers, said first control knob having a pin extending into a curved groove formed in said second control knob for rotatably displacing said first control knob responsive to rotation of said second control knob while permitting rotative displacement of said first control knob without displacement of said second control knob, whereby rotative displacement of said first control knob a provides a full flush operation and rotative displacement of said second control knob provides a partial flush operation.

* * * * *